US005087462A

United States Patent [19]

Bekele et al.

[11] Patent Number: 5,087,462

[45] Date of Patent: * Feb. 11, 1992

[54] VACUUM SKIN PACKAGES WITH REDUCED PRODUCT DISCOLORATION AND METHOD OF MAKING

[75] Inventors: Solomon Bekele, Taylors; Allen C. Williams, Jr., Spartanburg, both of S.C.

[73] Assignee: W. R. Grace & Co.-Conn, Duncan, S.C.

[ * ] Notice: The portion of the term of this patent subsequent to Mar. 20, 2007 has been disclaimed.

[21] Appl. No.: 420,182

[22] Filed: Oct. 12, 1989

Related U.S. Application Data

[63] Continuation of Ser. No. 194,741, May 13, 1988, Pat. No. 4,910,033.

[51] Int. Cl.[5] ..... B65D 81/20

[52] U.S. Cl. ..... 426/129; 53/433; 206/503; 426/396

[58] Field of Search ..... 426/127, 418, 396, 129; 53/437, 433, 434; 206/503

[56] References Cited

U.S. PATENT DOCUMENTS

| | | | |
|---|---|---|---|
| Re. 30,009 | 5/1979 | Perdue et al. | 53/433 |
| 2,621,129 | 12/1952 | Ramsbottom et al. | 426/127 |
| 2,859,122 | 11/1958 | Maturi et al. | 426/232 |
| 3,491,504 | 1/1970 | Young et al. | 53/22 |
| 3,574,642 | 4/1971 | Weinke | 99/174 |
| 3,616,943 | 11/1971 | Brink | 426/419 |
| 3,681,092 | 8/1972 | Titchenal et al. | 99/174 |
| 3,713,849 | 1/1973 | Grindrod et al. | 99/174 |
| 4,055,672 | 10/1977 | Hirsch et al. | 426/127 |
| 4,253,600 | 3/1981 | Schubert | 426/418 |
| 4,642,239 | 2/1987 | Ferrar et al. | 426/127 |
| 4,812,320 | 3/1989 | Ruzck | 426/129 |
| 4,818,548 | 4/1989 | Cheng | 426/396 |
| 4,910,033 | 3/1990 | Bekele et al. | 426/129 |

FOREIGN PATENT DOCUMENTS

| | | | |
|---|---|---|---|
| 245774 | 2/1963 | Australia . | |
| 1429001 | 3/1976 | United Kingdom | 53/427 |

*Primary Examiner*—Arthur L. Corbin

*Attorney, Agent, or Firm*—William D. Lee, Jr.; Leigh P. Gregory; Mark B. Quatt

[57] ABSTRACT

Discoloration of meat products due to oxygen starvation in stacked packages is significantly reduced by applying a textured surface to the bottom of the packages. A discrete textured film may be adhered to a tray or supporting member, or the tray or supporting member may itself be textured at its bottom surface.

6 Claims, 3 Drawing Sheets

VACUUM SKIN PACKAGES WITH REDUCED PRODUCT DISCOLORATION AND METHOD OF MAKING

This is a continuation application of application Ser. No. 194,741, filed on May 13, 1988, now U.S. Pat. No. 4,910,033.

FIELD OF THE INVENTION

This invention relates generally to vacuum skin packages. Particularly, the present invention relates to packages wherein a barrier layer or layers may be peeled and separated from a gas permeable layer or layers, and to a package and method of producing a package wherein discoloration of a meat product caused by stacking the packages is substantially reduced or prevented.

BACKGROUND OF THE INVENTION

Skin packaging can be classified as a vacuum forming process for thermoformable polymeric films. The product on a supporting member serves as the mold for the thermoformable film which is formed about the product by means of differential air pressure. However, the term "vacuum skin packaging" or VSP as it is referred to hereinafter, refers not only to the fact that the thermoformable film is formed around the product by vacuum or differential air pressure but more to the fact that the product is packaged under vacuum and the space containing the product is evacuated. Thus, there is a need for the film formed around the product and for the support member to be a barrier to oxygen, air, and other gases.

In conventional skin packaging, a backing board which is porous or which is perforated so that a vacuum may be drawn directly through the backing board is employed. In vacuum skin packaging processes generally a vacuum chamber with an open top is used. The product on an impervious backing board is placed on a platform within the vacuum chamber. The top of the chamber is covered by a sheet of film which is clamped tightly against the chamber to form a vacuum tight closure. The chamber is evacuated while the film is heated to its forming and softening temperature. The platform is then raised to drive the product into the softened film and air pressure can be used above the film to force it tightly around the product. A process of this type is disclosed in French Patent No. 1,258,357 which issued to Alain G. Bresson on Mar. 6, 1961.

A variant of the process described in the Bresson patent is disclosed in French Patent No. 1,286,018 which issued on Jan. 22, 1962 to LaRoach Freres Limited. In the LaRoach Freres process, after the chamber has been evacuated and the product driven into the heat softened film, the vacuum is released and ambient air is permitted to enter the chamber so that the thermoplastic film molds more or less onto the product since there is a vacuum on the product side of the film and ambient air pressure on the other side of the film. Australian Patent No. 245,774 which issued to Colbros Proprietary Limited et al on July 16, 1967 discloses a vacuum skin packaging process in which an article to be packaged is inserted within the lower half of a vacuum chamber on a backing board, a thermoplastic film is placed over the open face of the lower half of the chamber, the chamber is closed and both halves are brought to essentially the same state of vacuum, the film is heated and softened, and then atmospheric air is introduced into the upper half of the chamber so that it alone forces the thermoplastic film down around the product and against the backing board.

In another prior art version of vacuum skin packaging disclosed in U.S. Pat. No. 3,491,504, which issued to W. E. Young et al on Jan. 27, 1970, heat softened film is physically moved down over a stationary product and, in connection with air pressure, the softened thermoplastic film is molded onto the product.

In U.S. Pat. No. RE.30,009, which was reissued on May 29, 1979 to Richard R. Perdue et al, a thermoformable or heat softenable film sheet is drawn by differential air pressure against the concave interior surface of the upper portion of a vacuum chamber, the film is then heated by surface contact, and then, after evacuation of the chamber, air pressure is used to blow the heat softened film down over the product and against the backing board. The resulting package comprises the product positioned on the backing board which is gas impervious and the product is held there by the thermoformable film which has been formed around the product in the exact shape of the product so that it appears to be a "skin." The thermoformable film, as stated previously, is also gas impervious and usually will consist of a number of layers each of which performs a specific function. The product contact and backing member contact layer will be a sealing or heat sealable layer, an interior layer will typically be a barrier layer which comprises a vinylidene chloride copolymer (PVDC) or a hydrolyzed ethylene/ vinyl-acetate copolymer (EVOH), and the outer surface layer will be an abuse layer to protect the barrier layer from scratches, pin holes, or moisture attack.

In U.S. Pat. No. 3,574,642 which issued on Apr. 13, 1971 to Carl Frederick Weinke, a package for and a method of packaging meats is disclosed. The package includes an inner oxygen-permeable member which may be either gas flushed or evacuated and an outer oxygen-impermeable member which may also be gas flushed or evacuated. The package preserves the freshness of the meat until the meat is ready to be marketed to the consumer. For marketing, the outer wrapper is removed and the inner package is displayed at the meat counter for the consumer. Being oxygen-permeable, the inner wrapper admits oxygen to the interior of the package causing the fresh meat product to change to a bright red color which the consumer associates with freshness. The inner pouch of the Weinke package may consist of polyethylene film and the outer pouches may be cellophane film with a coating of saran (vinylidene chloride copolymer or PVDC.) Another patent showing portions of fresh meat individually packaged in oxygen permeable plastic film and inserted into an outer container of impermeable film is U.S. Pat. No. 3,681,092 which issued to Oliver R. Titchenal et al on Aug. 1, 1972.

Another prior art package is described in U.S. Pat. No. 3,713,849 which issued to Paul E. Grindrod et al on Jan. 30, 1973. In the Grindrod et al patent a fresh meat package having an outer oxygen impermeable lamina which is readily and entirely peelable from an inner oxygen-permeable lamina is disclosed. The package includes means for initiating the peeling separation along an edge of the package. The outer oxygen barrier maintains meats in well preserved condition in spite of the purplish color which has low consumer appeal. Shortly prior to display for sale to the consumer the outer lamina is removed by the retailer and the product develops a healthy, bright red "bloom" due to the high rate of oxygen permeation through the inner remaining film package. The material disclosed in Grindrod et al is a laminate of PVC/Saran and EVA/Saran. (EVA designates ethylene/vinyl-acetate copolymer and PVC designates polyvinyl-chloride.) The EVA and PVC layers are the inner layers and at the periphery of the package they are sealed together but form a weak bond. The saran layers can be readily peeled from the respective EVA or PVC layers as saran does not form a strong bond between either. Gripping tabs are also provided.

Yet another peelable package is shown in U.S. Pat. No. 4,055,672 which issued on Oct. 25, 1977 to Arthur Hirsch et al. In the Hirsch et al patent a semi-rigid tray of oxygen impermeable material is formed, a meat product placed therein, and then the tray is sealed around its upper periphery or flange area by a composite lid which has an inner layer of oxygen permeable material, an adhesive layer, and an outer layer of oxygen impermeable material. When the package is ready for retail display so that oxygen can reach the fresh meat packaged within the tray, the outer impermeable lid is peeled away so that the oxygen can penetrate through the remaining oxygen permeable portion of the lid. Accordingly, an object of the present invention is to provide a package with a strippable or peelable barrier layer which is an improvement over prior art packages.

In a number of instances in order to preserve a meat product within an impermeable film, it is desirable to provide a modified atmosphere which may include inner gases such as nitrogen or the like or an atmosphere which has a mixture of gases such as oxygen and carbon dioxide to control the bacterial growth within a package. Typical packages are disclosed in U.S. Pat. No. RE.27,872 which issued on Jan. 8, 1974 to J. J. Estes; U.S. Pat. No. 2,623,826 which issued on Dec. 30, 1952 to Sanford R. Grinstread; U.S. Pat. No. 3,360,382 which issued on Dec. 26, 1967 to H. V. Miller; U.S. Pat. No. 4,522,835 which issued on June, 11, 1985 to Richard E. Woodriff; U. K. Patent No. 1,199,998 which was published July 22, 1970; Canadian Patent No. 890,766 which issued Jan. 18, 1972 to Charles M. Davison et al; U. K. Patent No. 1,378,140 which was published Dec. 18, 1974; and U. K. Pat. No. 1,186,978 which was published Apr. 8, 1970. U.S. Pat. No. 2,925,346 which issued Feb. 16, 1960 discloses a process of packaging cured meat products and inhibiting color degradation by removing oxygen and back filling the container with a gaseous oxide of nitrogen.

In order to readily open packages where plastic, film layers have been sealed together to close the package, various tear tabs and easy open mechanisms have been devised. One such easy-to-open, delaminating seal is disclosed in U.S. Pat. No. 4,638,913 which issued on Jan. 27, 1987 to Milton A. Howe, Jr..In this patent, two grippable film folds are provided and the folds when pulled apart will rupture one of the outer layers of the sealed together film and delaminate the film to its edge. In such a case, of course, the bond strength between the two sealed together films must be greater than the layer-to-layer bond of the film. Accordingly, it is still another object of the invention to provide a package which is readily openable.

In copending U.S. application Ser. No. 135,870, now U.S. Pat. No. 4,890,739, and Ser. No. 136,680, now U.S. Pat. No. 4,886,690, assigned to a common assignee with the present application, peelable vacuum skin packages are described in which a peelable barrier layer is incorporated into the package material so that fresh red meat products such as beef, lamb, or pork can be stored for relatively long periods of time in a retail package. When ready for the retail showcase, the barrier layer can be peeled from the package, thereby permitting penetration of oxygen through the remaining permeable film to allow the meat product to bloom and turn a bright red color. Such a package has a gas impervious substrate or support member preferably in the form of a flat or shaped tray on which the meat product is placed during packaging. Since these and similar packages are designed for the retail display case, it would be common practice to stack multiple packages one on top of another in the display case because of space constraints. The inventors have found that such stacking of retail VSP packages having a non-barrier top web and a smooth barrier support member i.e. bottom web or tray can sometimes result in discoloration of all or part of the meat product contained in the next lowermost package in the stacked array. It is believed that this discoloration is caused by oxygen starvation of the meat surface in the next lowermost package. Such discoloration can adversely affect the appeal of the retail product to the purchaser, and thus defeat the advantage to be gained by the use of peelable VSP packaging. It is therefore an object of the invention to provide a package and method for substantially reducing or preventing the discoloration of meat products in a stacked array.

The foregoing and other objects are achieved by the present invention which is summarized in the Summary of Invention below, shown in the attached Drawings, and further described in the Detailed Description.

SUMMARY OF THE INVENTION

In one aspect, a skin package comprises a gas impervious support member having a top surface and a textured bottom surface; a meat product held securely to the top surface of the support member; and a film member which holds the product to the support member, said film member including a first portion which conforms to the shape of the product, and a second portion sealed to the top surface of the support member around the periphery of the product.

In another aspect, the present invention is a skin package comprising a gas impervious support member having a top surface and a bottom surface; a meat product held securely to the top surface of the support member; a film member which holds the product to the support member, said film member including a first portion which conforms to the shape of the product, and a second portion sealed to the top surface of the support member around the periphery of the product; and a thermoplastic film, at least one surface of which is a textured surface, adhered to the bottom surface of the support member such that the textured surface is the bottom surface of the package.

In another aspect, a method of reducing discoloration of a meat product in a first skin package having a gas impervious support member, when a second skin package of the same type is stacked on top of said first package, comprises creating a textured pattern to the bottom surface of the support member of the second package, such that when the second package is stacked on the first package, the textured surface is in contact with the top of the first package.

In another aspect, a method of reducing discoloration of a meat product in a first skin package having a gas impervious support member, when a second skin package of the same type is stacked on top of said first package, comprises adhering a thermoplastic film, at least one surface of which is a textured surface, to the bottom surface of the support member of the second package, such that when the second package is stacked on the first package, the textured surface of the thermoplastic film is in contact with the top of the first package.

In another aspect of the present invention, a method of making a skin package comprises feeding a gas impervious material toward a loading station, said material having a top surface and a textured bottom surface; loading a meat product onto the top surface of the textured material at the loading station; covering the product and top surface of the textured material with a film member; and sealing the film member to the top surface of the textured material.

A method of making a skin package useful in reducing meat discoloration comprises feeding a gas impervious thermoplastic material toward a loading station, said material having a top surface and a bottom surface; adhering a thermoplastic film, having a first surface and a second textured surface, to the bottom surface of the material so that the first surface of the film is adhered to the bottom surface of the material; loading a meat product onto the top surface of the material at the loading station; covering the product and the top surface of the material with a film member; and sealing the film member to the top surface of the material.

A method of making a skin package useful in reducing meat discoloration comprises feeding a gas impervious thermoplastic material to a thermoforming station, said material having a top surface and a bottom surface; heating the material to its forming temperature; drawing the heated material into a mold to form a thermoformed support member with a textured bottom surface, said mold having an interior bottom surface with a textured pattern; moving the support member from the mold to a loading station; loading a meat product onto the top surface of the support member at the loading station; covering the product and top surface of the support member with a film member; and sealing the film member to the top surface of the support member.

A method of making a skin package useful in reducing meat discoloration comprises feeding a gas impervious thermoplastic material toward a loading station, said material having a top surface and a bottom surface; loading a meat product onto the top surface of the thermoplastic material at the loading station; covering the product and top surface of the thermoplastic material with a film member; sealing the film member to the top surface of the material; and adhering a thermoplastic film, having a first surface and a second textured surface, to the bottom surface of the material so that the textured surface is the bottom surface of the final package.

DESCRIPTION OF THE DRAWINGS

In the drawings which are attached hereto and made a part of this disclosure.

DETAILED DESCRIPTION OF THE PREFERRED EMBODIMENTS

Figure 1:
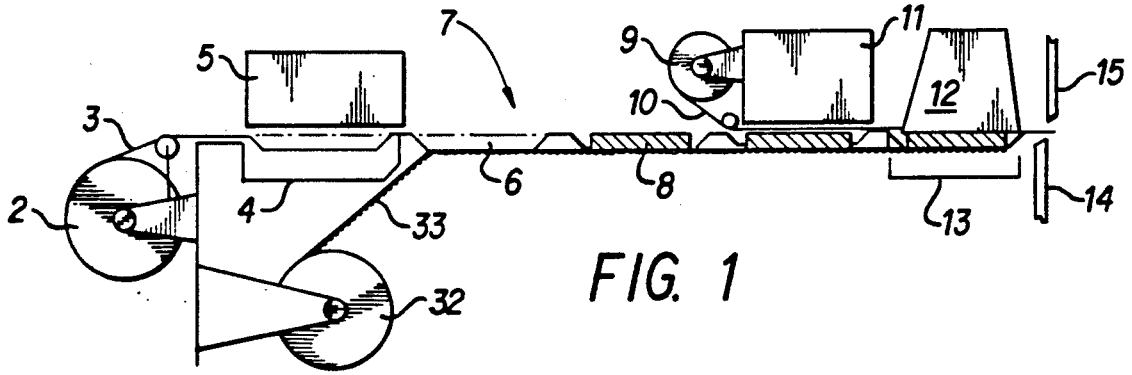
FIG. 1 is a schematic representation of a continuous process by which the present invention can be accomplished.

Referring first to FIG. 1, one embodiment of a process for making a vacuum skin package of the type which can utilize the present invention will be described. In FIG. 1, sheet-like material 3 to form the support or bottom web is unrolled from roll 2. The bottom web 3 for vacuum skin packaging purposes must be a relatively impervious sheet and preferably will comprise a base layer of a thermoformable material such as semi-rigid polyvinyl chloride (PVC) which is coated with saran (vinylidene chloride copolymer or PVDC) which coating is coated with a heat sealable material such as a Surlyn brand ionomer or a suitable ethylene/vinyl-acetate copolymer (EVA). As the material moves to the right it passes over a mold 4 for the tray and under a heater unit 5. At this station, a thermoforming operation takes place in which the web 3 is heated by heater 5 by preferably using a heater plate in which vacuum holes are placed to draw the web 3 up against the heater plate until the web is heated to its softening and forming temperature and then release the web at which time vacuum in holes distributed across the surface of the mold 4 will draw the softened and formable web 3 down into the mold where it assumes the shape of the mold. After cooling and setting, the now formed tray 6 is moved to the right to the product loading station 7. As an alternate, mold 4 and heater 5 can be eliminated and a flat support web be used instead.

As the formed tray 6, or alternatively flat support web 6', is moved toward the product loading station 7, a textured film 33 is unrolled from roll 32 and adhered by any suitable means to the bottom surface of the tray 6 or flat support web. Depending on the materials utilized for the bottom web 3 and textured film 33, suitable adhesion techniques may include the use of conventional lamination adhesives, corona discharge treatment of one or both facing surfaces of web 3 or film 33 respectively, and/or heating of the respective materials prior to bringing them into contact.

At the loading station 7, product 8 to be packaged will be loaded into the tray. The trays in one embodiment are formed three across so that each set of trays as they leave the mold 4 form a column of trays across the width of the web. The operator at station 7 will place a product either in each tray or on the appropriate spot of the flat backing member 6. One preferred product is beefsteak 1" to 1½" thick. Alternately, rectangular blocks of cheese or other meat or food products can be packaged.

Figure 2:
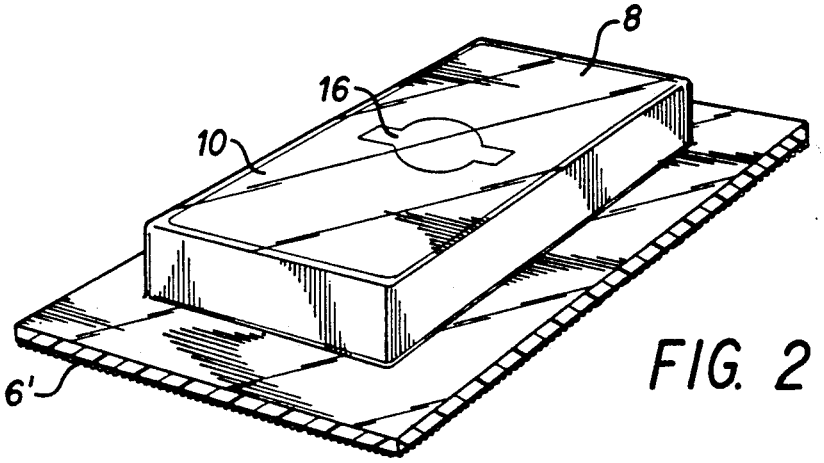
FIG. 2 is a perspective representation of a package showing one embodiment of the present invention.

At loading station 7 when the products 8 are loaded a label 16 (see FIG. 2) may then be placed on the horizontal upper surface of the products so that the heat sealable, printed surface of the label faces upwardly. Alternately, the labels may be on a continuous strip and held by a roll and dispensed adjacent the column of products much like an adhesive tape dispenser.

Figure 6:
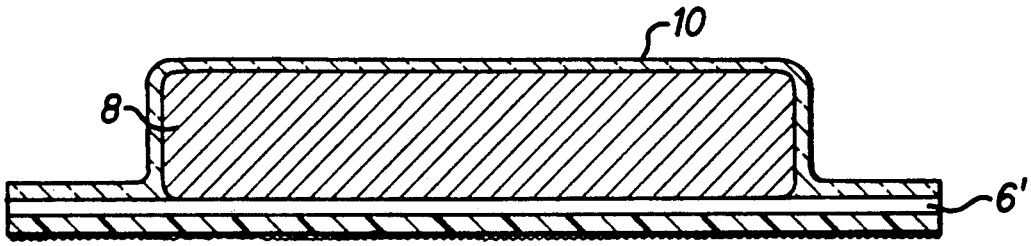
FIG. 6 is a schematic representation of a cross section of a package of the type shown in FIG. 2 and differs from FIG. 4 in that the package has a textured bottom surface.
Figure 7:
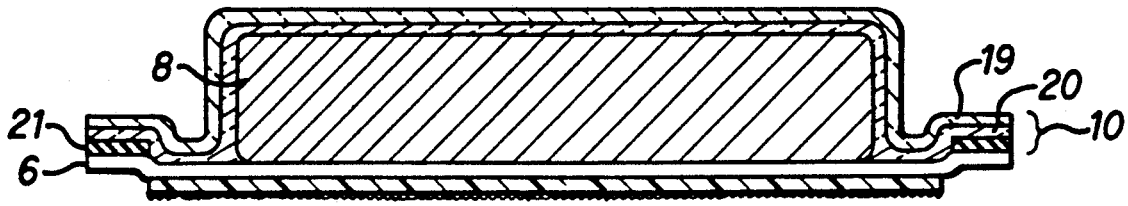
FIG. 7 is a schematic representation of a cross section of a package generally of the type shown in FIG. 3 and differs from FIG. 5 in that the package has a textured bottom surface.

When the product, optionally with the label thereon, has been properly positioned, the array, usually consisting of one column of products moves to the preheating station where the covering web 10 is fed from roll 9. The covering or forming web 10 may be a single layer film or more preferably may be a two component or composite film as can be seen in FIGS. 6 and 7 respectively. The outer film 19 can be a layer of saran and the inner or sealable layer 20 can be a layer of PVC. Such a film is described in the above mentioned U.S. Pat. No. 3,574,642 to Weinke. In general, any suitable covering or thermoforming web may be used if the peelable feature is not desired. Any suitable forming web can be used but it preferably includes a gas barrier layer. Such a film will usually be a multi-layer film comprising a sealing layer of an ionomer, branched, low density polyethylene (LDPE), ethylene vinyl acetate copolymer (EVA) or ultra low density polyethylene (ULDPE) of a density less than about 0.912 grams/cc. A barrier layer will be included which will comprise either saran or ethylene/vinyl alcohol copolymer (EVOH) which is sometimes referred to as hydrolyzed ethylene/vinyl acetate copolymer. Also included is a forming or support layer which may be PVC, LDPE, EVA, LLDPE (linear low density polyethylene), or VLDPE (very low or ultra low density polyethylene). Thus, in schematic fashion, the forming web preferably comprises these components: sealing layer/barrier layer/formable layer. Such a film is, of course, not limited to three layers.

Figure 3:
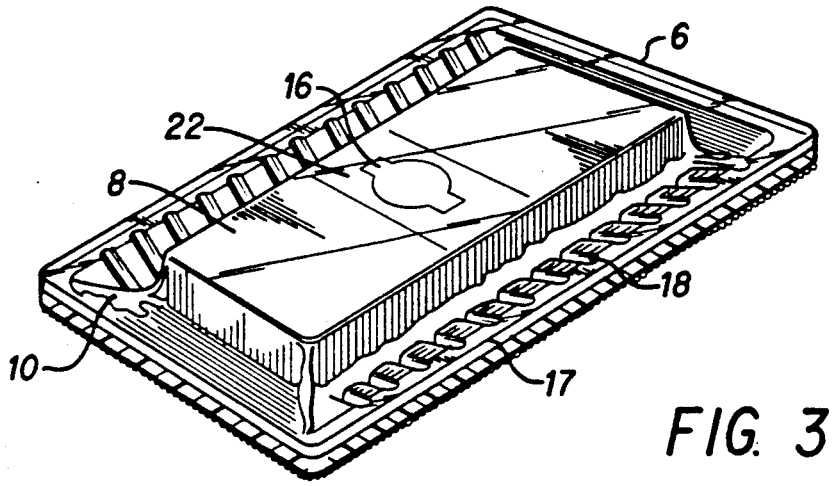
FIG. 3 is a perspective view of a package showing one embodiment of the present invention.

When the forming web 10 is preheated at station 11 the heated film and product on a support web are moved to the next station 12, 13 where the product is enclosed in a vacuum chamber having upper action or covering dome 12 and lower or bottom section half 13. Inside the dome the covering web 10 may be drawn up against the heated interior of the dome and held there in a concave fashion while the product containing space is evacuated in accordance with a preferred process described in the above mentioned U.S. Pat. No. Re. 30,009 to Perdue. When the chamber has been evacuated, the web 10 which has been held by vacuum against the dome interior surface is released and atmospheric pressure is applied on its upper surface thus causing the pressure differential between atmospheric pressure in the evacuated chamber to force the heated film down around the product and assume the product's shape. As the sealable surface of the covering web 10 comes in contact with the product 8 and tray 6 it will seal and adhere thereto so that the individually finished packages will have cross sections as shown in FIGS. 6 or 7 and the overall appearance will be a package such as that shown in FIG. 2 where the support web 6' is flat or in FIG. 3 where the support web is a tray.

As can be seen in FIGS. 2, 3, 6, and 7, the covering web by reason of the pressure differential is forced against the product 8 and tray 6 or flat support web 6' and adheres firmly and smoothly thereto. It is preferred that the product surface be relatively flat and smooth but the vacuum skin process can accommodate varying shapes and surface non-uniformities.

The invention will find significant use and advantage in vacuum skin packages which are used to not only store fresh red meat products such as beef, lamb, and pork, but also to display them in the retail store showcase. By way of example, a beefsteak 8 (refer to FIG. 7) is positioned on an impervious tray 6 or flat support web 6' and covered by a composite film 10 having a barrier layer 19 and a heat sealable layer 20. When packaged, the steak 8 is under vacuum and oxygen has been removed completely from the interior of the package during the vacuum skin packaging process. In this condition, the meat will turn a "purplish" color but may be stored, preferably below about 35° F., and more preferably at about 28° to 32° F., unfrozen for periods up to 21 to 30 days. When ready for the retail showcase, tab 21 is simply lifted up and the heat sealable layer 20 which has a lower cohesive strength than the bond force between layer 20 and support member 6 will rupture and allow the peelable barrier layer 19 to be removed. When this barrier layer is removed, the heat sealable layer 20 which is a gas pervious film, will allow the penetration of oxygen to the purplish colored meat and as the oxygen reacts with the myoglobin pigment the meat will "bloom" and turn a bright red color which makes the product quite appealing to the retail purchaser.

Figure 4:
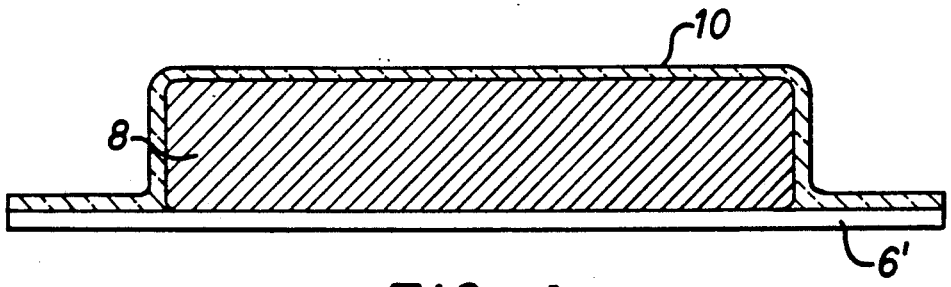
FIG. 4 is a cross sectional representation of a completed vacuum skin package.
Figure 5:
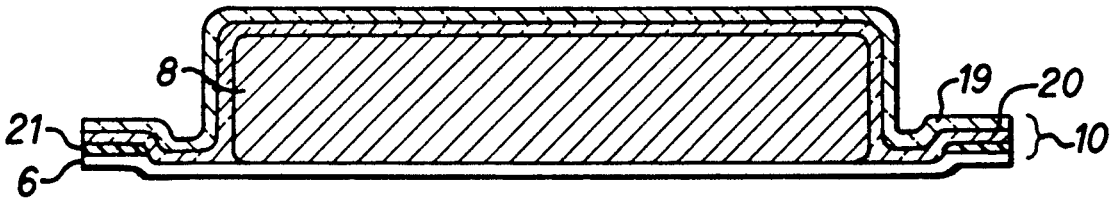
FIG. 5 is a cross sectional representation of a completed peelable vacuum skin package.
Figure 8:
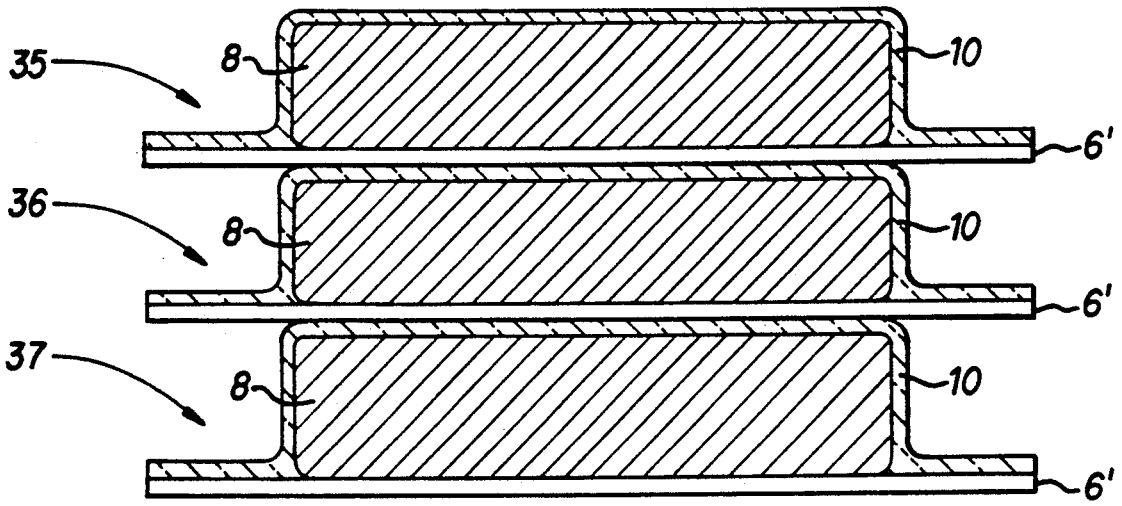
FIG. 8 is a schematic representation of a cross section through three of the products shown in FIG. 4 stacked one on top of another; and, FIG. 9 is the same cross section as FIG. 8 but showing the textured surface on the bottom of each package.

It has been found that when packages of the type illustrated in FIGS. 4 and 5 are stacked one on top of another, discoloration of meat product 8 can sometimes occur. A stacked array is illustrated in FIG. 8, and shows that support web 6' in an uppermost package 35 is in substantial contact with forming web 10 of the next lowermost package 36. When the bottom surface of support web 6' is substantially smooth, the close contact between support member 6' and the upper surface of forming web 10 of package 36 can result in oxygen starvation of the upper portion at least of meat product 8 in package 36. When this occurs, the bright red bloom color desired in fresh red meat such as beef is at least partially lost, and brown or purple spots can occur depending on the degree of contact between the respective supporting member and the forming web.

It has now been found that by introducing a textured surface to the interface between the supporting member of one package, and the top forming web of a next lowermost package in a stacked array, discoloration of a meat product can be substantially or even totally prevented.

Figure 9:
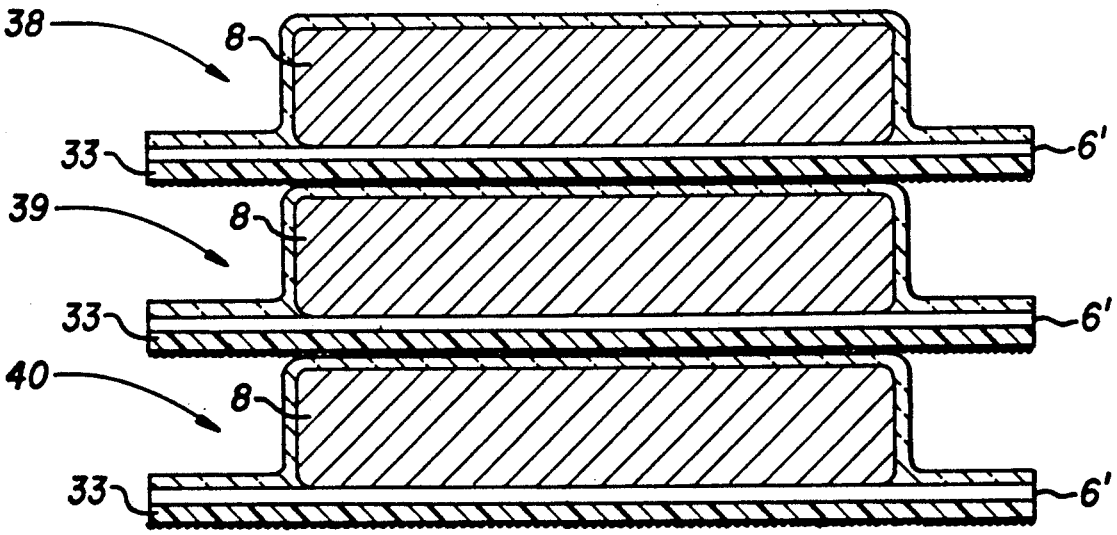

As depicted in FIG. 9, a textured film 33 with a textured surface one side of the film has been applied to the bottom of packages 38, 39, and 40. When the packages are stacked as in FIG. 9, it has been discovered that the presence of the textured surface at the interface between the supporting member of one package (e.g. 38) and the forming web of a next lowermost package (e.g. 39) in a stacked array substantially reduces or totally prevents discoloration of the meat product.

The benefits derived from the use of a textured surface as described are further illustrated by reference to the following examples.

As used herein, the terms "impervious" and "barrier" relating to webs, substrates and films formed from thermoplastic materials mean a film having an oxygen transmission of less than about 100 cc $O_2$ per 100 square inches per mil of thickness per 24 hour period at 73° F., and a "gas pervious" or "gas permeable" film or covering web means a film having a transmission rate for oxygen of greater than 2000.

"Textured" as used herein, means a material such as a film, laminate, sheet or web, monolayer or multilayer in construction, which has at least one surface with a non-smooth or roughened finish. The textured pattern may be formed onto the sheet, film or web by e.g. calendaring or embossing rolls during production of the material, or else introduced to an otherwise smooth-surfaced forming web by a modified bottom plate of a thermoforming die. The textured material by definition will have one surface which, when incorporated into or separately adhered to a bottom web or tray, results in better color characteristics (e.g. bloom in fresh red meat) when the textured surface is in contact with the top web of a completed skin package described in the application, compared with a non-textured surface.

An industry standard for measurement of texture is the "RA" value. This is a relative average of the size of peaks and valleys in a given area of material. The PR180/01 E-1 material of the examples has an RA value of about 8.3. A smaller textured material, PR180/01 E-2, has an RA value of about 3.0. Preliminary tests have suggested suitability of this material as well for reducing discoloration of meat.

It is believed that a relatively uniform distribution of the peaks and valleys in a textured material is also important in promoting good color characteristics in stacked, packaged meat, and that large areas without texturing and adversely affect color retention.

EXAMPLE

Boneless inside round steaks were packaged in a VS-44 vacuum skin packaging machine using a peelable barrier top web and a rigid barrier bottom web. After 24 hours the samples were peeled and allowed to bloom for 24 hours. Afterwards, a stack was made as a control (three packages high) and a treatment stack was made whereby a sheet of textured polyvinyl chloride material having an oxygen transmission rate of 20 cc/m$^2$/24 hours (one atmosphere), at 73° C. was placed between each of four stacked packages.

The PVC textured material had a thickness of 9.6 mils, and was supplied by Klockner Pentaplast, type PR180/01 E-1 which had a fine texture.

Discoloration was checked daily for three days.

The results are shown below in Table I.

TABLE I

| | % DISCOLORATION | |
|---|---|---|
| | CONTROL | TEXTURED |
| DAY 1 | Bottom 25% | Bottom 0% |
| | Middle 25% | Middle 0% |
| | | Middle 0% |
| DAY 3 | Bottom 60% | Bottom 0% |
| | Middle 55% | Middle 0% |
| | | Middle 0% |

These results show that the textured PVC interleaves allow for sufficient oxygen supplied to the non-barrier surfaces so that oxygen starvation and thus discoloration was prevented.

The reference to "bottom" in Table I indicates the lowermost package in each stack, and the reference to "middle" refers to the package intermediate the bottom and top, or two packages in the case of the textured treatment stack.

The control packages had a smooth bottom surface.

In another test, five ¾" thick ribeye steaks were vacuum skin packaged using a non-barrier top web on a non-textured semi-rigid polyvinyl chloride bottom web. These five packages were used as control packages.

Ten ¾" thick ribeye steaks were vacuum skin packaged using the same non-barrier top web and semi-rigid PVC bottom web as for the five control packages, but with an interleaf of textured 10 mil thick rigid polyvinyl chloride. The textured material was the same as that used in Example 1. The ten textured packages were divided into a first stack A and a second stack B, each stack having five packages.

The five control packages were stacked one on top of the other, as were each of the five packages of stack A and stack B, and each stack was observed over a five day period. The results are shown in Table II below.

TABLE II

Samples were stacked 5 steaks/stack and observed over a 5-day period.

| | Control | Textured (Stack A and B) Stack A | Stack B |
|---|---|---|---|
| | | (Top) | |
| Day 1 | Steak #1 0% Discoloration | Steak #1 0% | 1 0% |
| | Steak #2 20% Discoloration | Steak #2 0% | 2 0% |
| | Steak #3 20% Discoloration | Steak #3 0% | 3 0% |
| | Steak #4 45% Discoloration | Steak #4 0% | 4 0% |
| | Steak #5 70% Discoloration | Steak #5 0% | 5 0% |
| | | (Bottom) | |
| Day 3 | Steak #1 0% Discoloration | Steak #1 0% | 1 0% |
| | Steak #2 35% Discoloration | Steak #2 0% | 2 0% |
| | Steak #3 50% Discoloration | Steak #3 0% | 3 0% |
| | Steak #4 60% Discoloration | Steak #4 0% | 4 2% |
| | Steak #5 80% Discoloration | Steak #5 5% | 5 0% |
| Day 5 | Steak #1 0% Discoloration | Steak #1 0% | 1 0% |
| | Steak #2 35% Discoloration | Steak #2 0% | 2 0% |
| | Steak #3 55% Discoloration | Steak #3 0% | 3 0% |
| | Steak #4 60% Discoloration | Steak #4 0% | 4 5% |
| | Steak #5 85% Discoloration | Steak #5 5% | 5 0% |

The control steaks exhibited the characteristic discoloration attributable to oxygen starvation, whereas the steaks of stack A and stack B having the textured dividers showed little to no discoloration even on the bottom cuts in each of stack A and stack B.

The foregoing description is by way of illustration and is not limiting on the scope of the invention described as other embodiments and applications of the invention will become evident to those skilled in the art as they become familiar with the invention. The invention is limited only by the scope of the claims which follow and are appended hereto.

For example, while the preferred embodiment provides for a discrete textured film 33 adhered to the bottom of a tray or flat supporting member, the tray or supporting member itself can be textured at its bottom surface to eliminate the need for a separate textured film. This may be accomplished either before or after the forming step in the case of a formed tray, provided that the tray material and the processing conditions are such that a tray material textured before the forming step does not lose its textured quality during thermoforming. Even in the case of a discrete textured film 33, depicted in FIG. 1 as applied to the bottom of a tray or flat supporting member after a thermoforming step, modifications may include the introduction of the separate textured film 33 before the thermoforming step, or even after the completed package is made, i.e. after the covering web 10 has been applied to the top of the product and tray or support member.

Another method which can be employed to provide a textured external bottom surface to a formed tray is the modification of the bottom forming plate in a thermoforming unit such as that depicted schematically at Reference 4 in FIG. 1. In this way, web 3, during the thermoforming step, would receive the textured imprint of the bottom plate of the forming die.

In a less preferred embodiment, sheets of textured film can be manually or automatically adhered to the bottom tray 6 or a flat supporting member without the use of a separate roll 32 to provide rollstock 33 of a textured film.

In lieu of the modification of the bottom forming plate, another technique which has shown some success is the attachment of a textured material (coarse sand paper) to the bottom plate.

It will also be noted that in FIG. 7, the textured film is depicted as extending across and adhering to the planar bottom portion only of the tray. In one modification, the textured film can in fact be extended in either direction, as viewed in FIG. 7, to be coextensive with tray 6 or flat support member 6'.

What is claimed is:

1. A skin package comprising:

a) a gas impervious support member having a top surface and a textured bottom surface, the peaks and valleys of the textured bottom surface having a thickness less than the average thickness of the support member;

b) a meat product held securely to the top surface of the support member; and c) a film member which holds the product to the support member, said film member including i) a first portion which conforms to the shape of the product, and ii) a second portion sealed to the top surface of the support member around the periphery of the product.

2. A method of reducing discoloration of a meat product in a first skin package, when a second skin package of the same type is stacked on top of said first package, the first package having:

a) a gas impervious support member, and b) a gas impervious film member which holds the product to the support member, comprising creating a textured pattern on the bottom surface of the support member of the second package, such that when the second package is stacked on the first package, the textured surface is in contact with the top of the first package, said textured pattern having an average thickness less than the thickness of the support member.

3. A method of making a skin package useful in reducing discoloration comprising:

a) feeding a gas impervious thermoplastic material toward a loading station, said material having a top surface and a textured bottom surface, the peaks and valleys of the textured bottom surface having a thickness less than the average thickness of the material;

b) loading a meat product onto the top surface of the textured material at the loading station;

c) covering the product and top surface of the textured material with a film member; and d) sealing the film member to the top surface of the textured material.

4. A method according to claim 3 further comprising between steps a) and b):

i) feeding the material to a thermoforming station;

ii) heating the material to its forming temperature;

iii) drawing the heated material into a mold to form a thermoformed support member; and iv) moving the support member from the mold to the loading station.

5. A method of making a skin package useful in reducing meat discoloration comprising:

a) feeding a gas impervious thermoplastic material to a thermoforming station, said material having a top surface and a bottom surface;

b) heating the material to its forming temperature;

c) providing a mold with an interior bottom surface having a textured pattern, the peaks and valleys of the textured pattern having an average thickness less than the thickness of the thermoplastic material;

d) drawing the heated material into the mold to form a thermoformed support member with a textured bottom surface;

e) moving the support member from the mold to a loading station;

f) loading a meat product onto the top surface of the support member at the loading station;

g) covering the product and top surface of the support member with a film member; and h) sealing the film member to the top surface of the support member.

6. A method of making a skin package useful in reducing meat discoloration comprising:

a) feeding a gas impervious thermoplastic material to a thermoforming station, said material having a top surface and a bottom surface;

b) heating the material to its forming temperature;

c) providing a mold having coarse sand paper attached to a bottom plate thereof;

d) drawing the heated material into the mold to form a thermoformed support member with a textured bottom surface;

e) moving the support member from the mold to a loading station;

f) loading a meat product onto the top surface of the support member at the loading station;

g) covering the product and top surface of the support member with a film member; and h) sealing the film member to the top surface of the support member.

* * * * *